United States Patent [19]

Knoop

[11] Patent Number: 4,540,393

[45] Date of Patent: Sep. 10, 1985

[54] VARIABLE LENGTH TAB-FORMING DEVICE FOR TAPE ROLL HOLDERS

[76] Inventor: Jack P. Knoop, 326 Avenida Arboles, San Jose, Calif. 95123

[21] Appl. No.: 538,230

[22] Filed: Oct. 3, 1983

Related U.S. Application Data

[63] Continuation-in-part of Ser. No. 294,533, Aug. 20, 1981, Pat. No. 4,437,854.

[51] Int. Cl.[3] ..... B26F 3/02

[52] U.S. Cl. ..... 493/353; 225/25; 493/419; 493/466

[58] Field of Search ..... 225/14, 21, 22, 24, 225/25, 34; 267/158, 164; 493/353, 419, 466

[56] References Cited

U.S. PATENT DOCUMENTS

| | | | |
|---|---|---|---|
| 2,300,423 | 11/1942 | Holben | 225/25 |
| 2,434,776 | 1/1948 | Van Cleef et al. | 225/21 |
| 2,476,593 | 7/1949 | Gerbing | 225/25 |
| 2,526,494 | 10/1950 | McNeil | 493/466 |
| 2,676,658 | 4/1954 | King | 225/34 |
| 2,709,049 | 5/1955 | Weis | 225/25 |
| 3,148,748 | 9/1964 | Young | 267/164 X |
| 3,810,567 | 5/1974 | Malcolm | 493/353 |

FOREIGN PATENT DOCUMENTS

| | | | |
|---|---|---|---|
| 828534 | 2/1960 | United Kingdom | 493/419 |

*Primary Examiner*—E. Michael Combs
*Attorney, Agent, or Firm*—Yoshio Katayama

[57] ABSTRACT

A tab-forming device for adhesive tape dispensers which provides for variable length tabs by incorporating a ratchet spool and pawl in a flexible spring for expanding the spacing between two attached diverging tab-forming struts. The device may be attached to existing tape roll dispensers or molded as an integral part with the dispenser.

19 Claims, 11 Drawing Figures

VARIABLE LENGTH TAB-FORMING DEVICE FOR TAPE ROLL HOLDERS

DESCRIPTION

Cross Reference to Related Application

This is a continuation-in-part of application Ser. No. 294,533, filed Aug. 20, 1981, U.S. Pat. No. 4,437,854.

TECHNICAL FIELD

The invention relates to tape dispensing apparatus and in particular to tape dispensing apparatus wherein tape tabs are formed at the head of a tape section to be dispensed.

BACKGROUND ART

Tape tab-forming devices are known. For example, U.S. Pat. No. 2,300,423 to H. Holben shows a tape roll holder having an arm actuated rocking member upon which tape normally rests. By pushing the arm downwardly, the rocking member moves back toward a tear-off station where a tape tab is formed by a loop of tape which comes together. A stop screw below the arm is adjusted to vary the space and the resulting tab length.

In U.S. Pat. No. 2,526,494 to G. McNeil a spring arm within a tape roll holder moves back and forth for the purpose of forming tape tabs.

In U.S. Pat. No. 3,204,949 H. Kieslich discloses a cam actuated set of rollers which form tape tabs in a tape dispenser.

In German specification No. 2,232,663, Malcolm describes a spring loaded cutter which is pulled away from the tape bearing surface and then released to form tabs with the tape.

These and other patents illustrate the utility of tape tabs associated with tape roll holders. Many of the prior art devices obtain the bias action of the tab-forming member by metal springs or mechanical arrangement which preclude the use of molded tape tab-forming devices. Most prior art devices usually provide only one preset tab length.

An object of the present invention was to devise a tape tab-forming device, which is characterized by a simplified low-cost construction, executed by molding and which permits preset variation in the tape tab length of definite incremental amounts.

Another object of the present invention was to devise a variable length tab-forming device which could be easily attached to existing tape dispensers in current use or molded with the tape dispenser.

DISCLOSURE OF INVENTION

The above objects have been met by a molded tape tab-forming device which incorporates a means for increasing by increments the distance between the upwardly diverging struts by expanding the diameter of a cylindrical spring hinging the struts. The device provides a quick change back and forth from one preset tab length to at least two other lengths without the use of auxiliary tools. The tab-forming device is characterized by a pair of upwardly extending forward and rearward struts having upper extremities terminating in wings. The lower extremities of the struts are hinged by a cylindrical molded flexible spring which limits the outward spreading of the upper extremities of the struts. The cylindrical spring incorporates the means for obtaining tabs of varying length. A pawl may be provided on the inside wall of the cylinder to engage one of three pawl seats in an inserted ratchet spool by which means the diameter of the cylinder may be increased resulting in an outward spreading of the struts. The wings provide support tables in the tape dispensing path so that a section of tape may be supported in two places and brought together to form a tab by self-adherence of the tape near the wings. This requires that the struts be pushed together to a closed position, bringing the wings into a wing-to-wing abutting relation. By changing the pawl position in the ratchet spool, thereby obtaining a wider or narrower open position of the struts, three sizes of tabs may be formed. The rearward strut may be provided with a downwardly extending leg and foot which is adapted to engage anchor members in an existing plastic tape roll holder. Normally, such anchor members secure a metal hook for tearing tape. Instead, the tape tearing hook may be connected to the forward strut, extending over the top of the forward wing and having a cantilevered forward serrated edge in the tape path for tearing tape.

The body of the tab-forming device is molded out of acetal plastic which has ability to return to its molded shape after stretching, such as when the struts are brought together thereby stretching the cylinder. A cutting edge may be molded of a different plastic which will retain a sharp edge such as acrylic. A locking mechanism is provided on the top of the forward strut to prevent separation of the two dissimilar plastic materials used for the body and the cutting edge.

The tape tab-forming device can be molded and housed within existing plastic tape dispensers, especially a widely used construction having split halves. The tape tab-forming device may also be incorporated in other roll holders since it is easily connected to a tape tear-off station. It may also be molded as a unit with the roll holder.

BEST MODE FOR CARRYING OUT THE INVENTION

Figure 1:
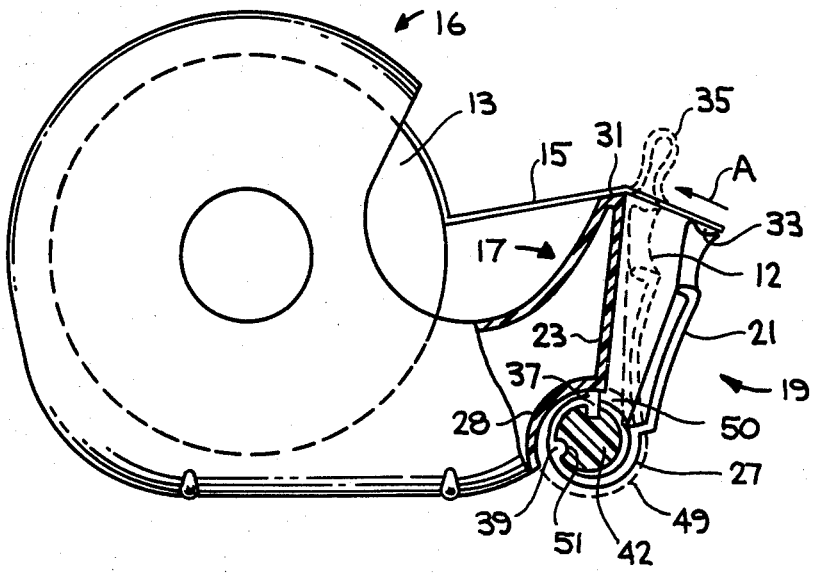
FIG. 1 is a partial cutaway view of a tape dispenser with the tape tab-forming device of the preferred embodiment of the present invention.

With reference to FIG. 1, an embodiment of a tape dispenser having an integral tape tab-forming device may be seen with two major components. The first major component is the roll holder 16 which supports a tape roll 13. This roll contains pressure sensitive tape with an adhesive backing on one side. The terminal span 15 of the tape is guided in a tape path toward the upwardly extending tape support station 17.

Figure 2:
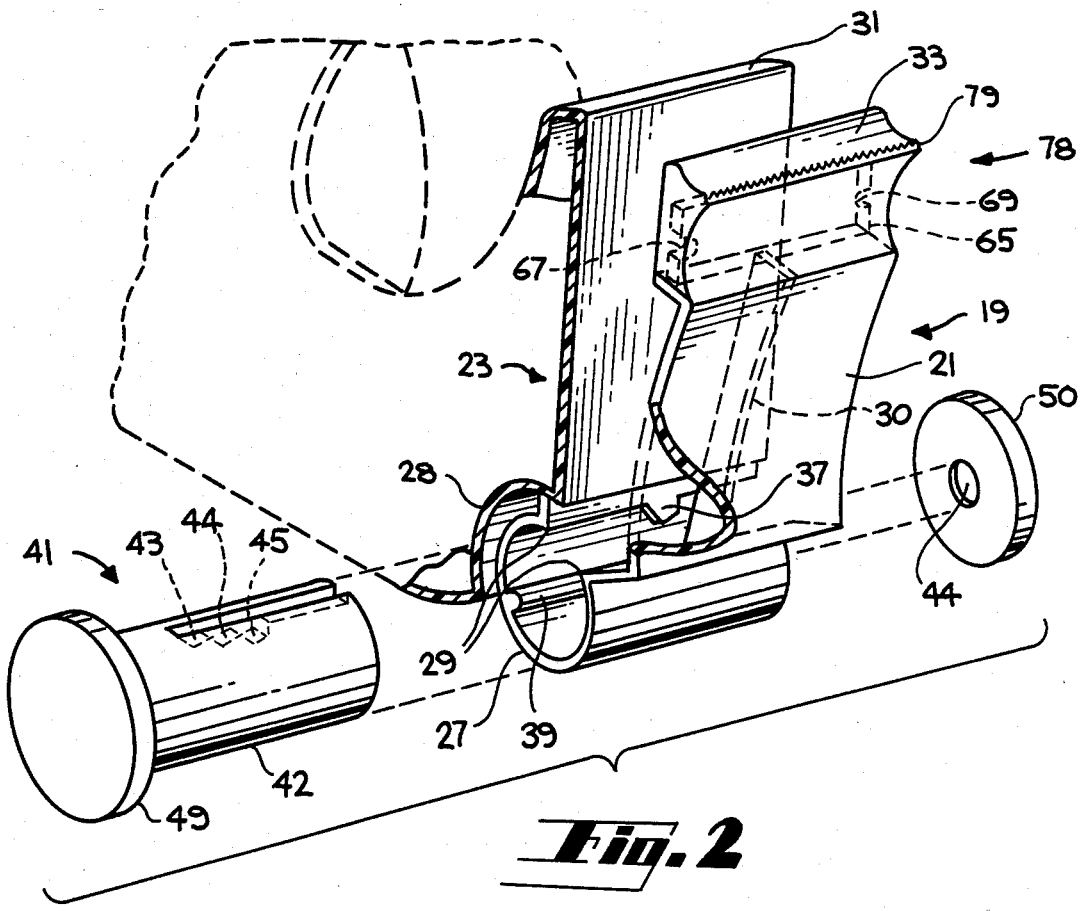
FIG. 2 is an exploded perspective front view of the tape tab-forming device of FIG. 1.
Figure 3:
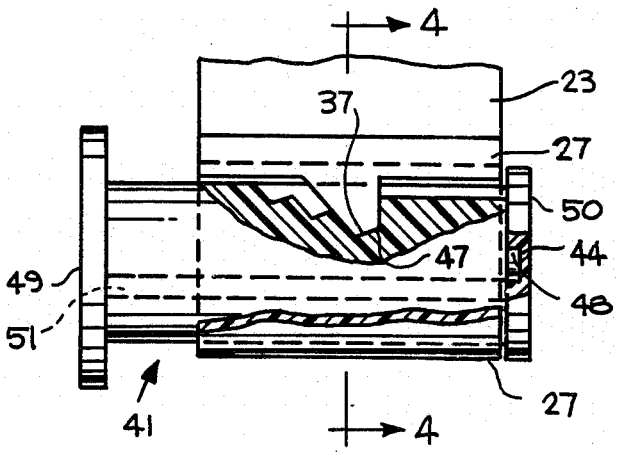
FIGS. 3, 5 and 7 are partial cutaway views of the ratchet spool and spring hinge of the tape tab-forming device of FIGS. 1 and 2.

The second major component of the embodiment of the present invention which may be viewed both in FIGS. 1 and 2 is the tape tab-forming device 19 which is connected to the upwardly extending station 17. In the embodiment of the tape dispenser as shown in FIG. 1, two members of the tape forming device 19 are the upwardly extending flexible forward strut 21 and the front strut 23 of station 17 of the roll holder. The lower extremities of these struts are hinged by means of cylindrical molded flexible spring 27. The upper extremity of strut 21 terminates in wing 33 which in combination with wing 31 on station 17 is used to support tape portions in order to form the tape tab 35. Cylindrical spring 27 maintains the upper extremity of strut 21 in a spaced-apart position from wing 31 on station 17. As shown in the embodiment of FIG. 1, the spring is set within a curved recess 28 at the bottom of station 17. A ratchet spool 42 of the preferred embodiment is retained in spring 27 by means of end buttons 49 and 50. Operation of this ratchet spool will be described in relation to FIGS. 2–8.

Operation of the tape tab-forming device is indicated in FIG. 1 by dashed lines 12 which indicate the closed position of struts 21 and 23. In operation, strut 21 is pushed backwards in a direction indicated by arrow A to the position indicated by the dashed lines 12 until a tape tab 35 is formed by bringing wings 31 and 33 into a wing-to-wing abutting relation or approaching such a relation. This tab may then be grasped by a user and the tape pulled forward and torn off at a desired length.

FIG. 2 shows the spring mechanism. Cylindrical spring 27 contains a lengthwise open slot 29. To the front edge of slot 29 is joined the bottom of forward strut 21. At the middle of strut 21 a vertical brace 30 gives additional strength during movement of the strut. To the back edge of slot 29 is joined the bottom of strut 23. In the preferred embodiment, means are provided for obtaining variable tab lengths. Extending down from the edge of the rear of slot 29 is pawl 37. A half-rounded guide bar 39 runs the length of the cylindrical spring. Guide bar and pawl are between 60 and 75 degrees apart. Ratchet spool 41 has a cylindrical body 42 containing three pawl seats 43, 45 and 47 as shown in FIG. 2. The pawl seats are in a step configuration of increasing depth. The preferred embodiment uses three pawl seats; however, more seats of different depths could be cut into the ratchet spool to provide for more than three tab lengths. The cylindrical body 42 of ratchet spool 41 is of a diameter to fit inside cylindrical spring 27. Ratchet spool 41 contains a larger diameter pushbutton 49 and a smaller diameter pushbutton 50 at front and back. The two pushbuttons are of larger diameters than the spring, thereby preventing the spool from sliding out of the cylindrical spring. As shown in FIG. 1, a half-rounded guide slot 51 runs longitudinally on body 42 for locking on to guide bar 39 on the spring. A small button 48, shown in FIG. 3, on the end of body 42 fits into hole 44 of pushbutton 50 for locking the body into the spring. In the preferred embodiment shown in FIG. 2 and described below, the tape tearing station 78 is molded over a locking device 65 having two retaining notches 67 and 69. A serrated cutting edge 79 is formed in the forwardly extending edge of wing 33.

The tab-forming device may be used for forming one fixed length tab by means of the biased apart struts on the slotted cylinder without the addition of the ratchet spool and pawl. However, in the preferred embodiment the interaction of the ratchet spool and cylindrical spring makes it possible to form tabs of three different lengths by movement of the pawl into any one of the three pawl seats which are of different depths.

Figure 4:
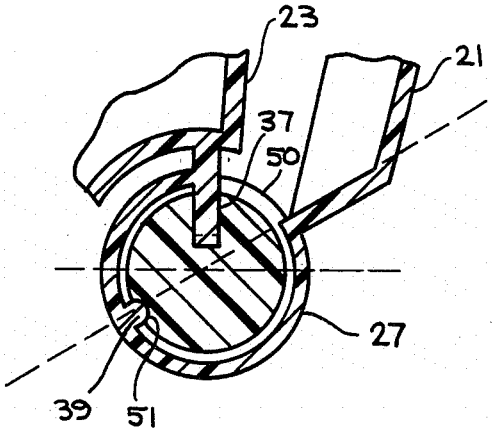
FIGS. 4, 6 and 8 are cross section views taken respectively along lines 4—4, 6—6 and 8—8 of FIGS. 3, 5 and 7.
Figure 5:
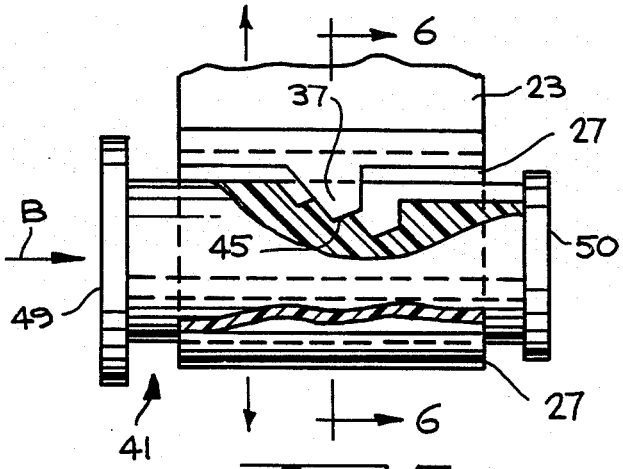
Figure 6:
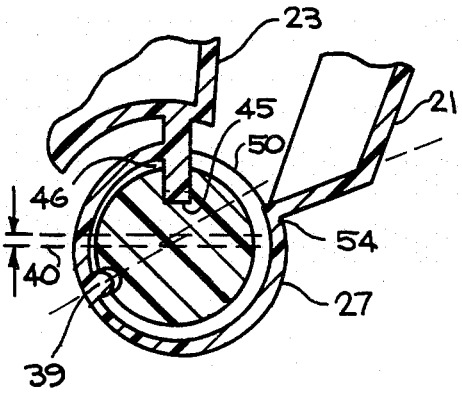
Figure 7:
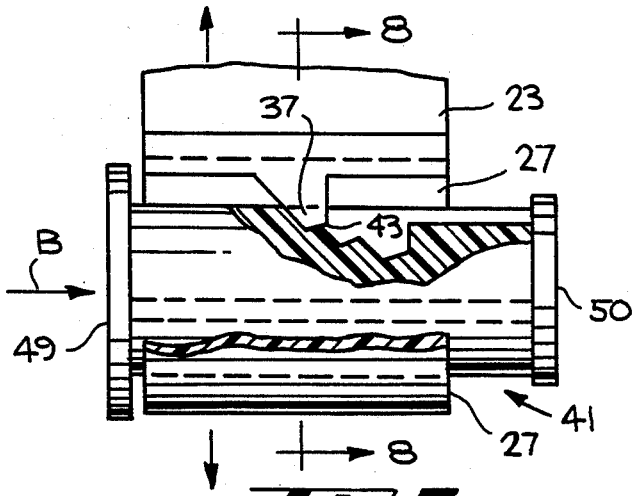
Figure 8:
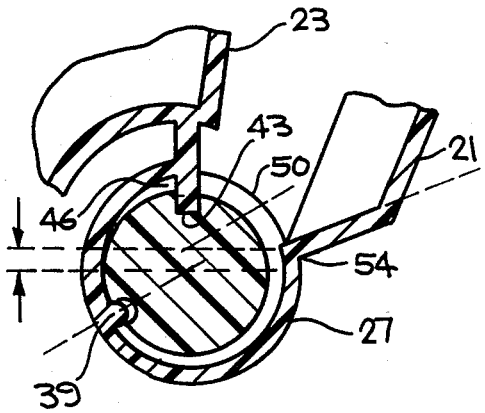

The tab-forming device is molded of a polymer so that the two struts are normally biased in an open position. The tab is formed when the two struts are pushed together in an abutting relation. The nature of the plastic material used forces the struts to return to their normal open position when the pressure is removed from strut 21. By means of the ratchet spool 41 this normal spaced apart position can be slightly expanded as shown in FIGS. 3 through 8. By pushing ratchet spool 41 so that pawl 37 is seated in the deepest pawl seat 47 the normal diameter of spring 27 is retained as in FIG. 3 and FIG. 4. As shown in FIG. 4, a cross section view taken along lines 4—4 of FIG. 3, guide bar 39 and guide slot 51 are of complementary half-rounded shape. The half rounding of both guide bar and the slot accommodates the slight movement that takes place when the pawl is moved from one position to the other. The guide bar prevents twisting of the ratchet spool in the spring. As shown in FIG. 5 and the cross section view of FIG. 6, positioning of the pawl into pawl seat 45 by pushing the ratchet spool in the direction of arrow B deforms the area of the spring between the pawl and guide bar 39, pushing the spring at point 46 away from the spool body, in effect increasing the diameter of the cylindrical spring by the distance 40 between the arrows and expanding the arc between the two struts 21 and 23. The pressure of the pawl against the pawl seat also pushes the spool against the guide bar, thereby pushing the spring outward at that point, increasing the diameter of the spring in the area between the guide bar 39 and point 54 where front strut 21 joins the spring, further increasing the arc between struts 21 and 23. As shown in FIG. 7 and the cross-section view of FIG. 8, the seating of the pawl in seat 43 again increases the diameter of the cylindrical spring and the distance between the two struts. This forced opening of the diameter of the cylindrical spring can result in three different tab lengths of, for example, from 3/16 to ¼ 5/16 of an inch. Springs which have larger pawls and deeper pawl seats may be used to obtain tabs of larger sizes. The pawl seats have ratchet angles of 45° and 15° corresponding to risers and treads in the step-wise configuration of the pawl seats. The bottom of the pawl has an angle of approximately 15 degrees with a matching 15 degrees in the bottom or tread of the seat which yields secure seating. The front end or riser of the pawl seat and the front of the pawl have matching 45 degree angles which make movement from one position to another easier. By placement of the large push button 49 on the end of the ratchet spool facing the 45 degree angle on the pawl and the smaller push button end 50 on the end of the ratchet spool facing a 15 degree angle inclination of the pawl, indication is given that pushing from the large push button side will increase the diameter of the cylindrical spring and thereby the tab length. Pushing from the small diameter push button 50 will correspondingly decrease the diameter of the spring resulting in smaller tab lengths.

In the preferred embodiment the front forward strut 21 of the tape forming device has a molded plastic polymer tearing edge as shown and described in regard to FIG. 1 and FIG. 2. The body of the tape tab former is made from a polymer material that should have sufficient rigidity to provide a spring-like quality, resistance to flexing fatigue and low tendency to stress cracking.

The class of polymeric materials known as acetal are well suited for purposes of the present invention. Acetal plastic has the ability to return to its molded shape after stretching, such as when the struts are brought together, thereby stretching the cylinder spring. Within the general class of acetal the following materials are particularly suitable: Delrin, manufactured by DuPont Chemicals and Celcon, manufactured by Celanese Chemicals. This type of plastic has a memory that forces the moving parts to contract to the smallest setting. Memory is built in when the parts are molded with this smallest configuration.

Because of this memory and resistance to cracking, the acetal plastic is not suitable for a tape cutting edge. For the cutter edge the polymer used is acrylic or polystyrene. In order to join these two dissimilar materials, locking device 65 shown in FIG. 2 is molded of acetal plastic at the upper end of forward strut 21 during molding of the body of the tab former. This locking device has two notches, 67 and 69, one at either side. Molding of the acrylic top containing the cutting edge 79 onto the locking device 65 of acetal plastic forms a retentive interlock which prevents sliding of the dissimilar plastics and consequent separation.

Figure 11:
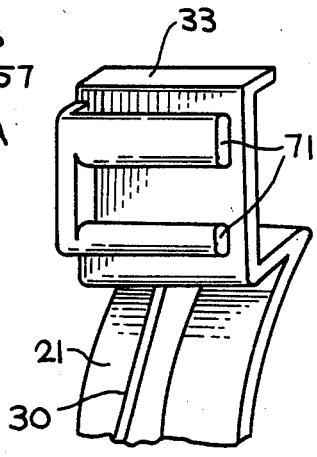
FIG. 11 is a perspective rear view of the upper extremity of a forward strut in the tape tab-forming device of FIG. 10.
Figure 10:
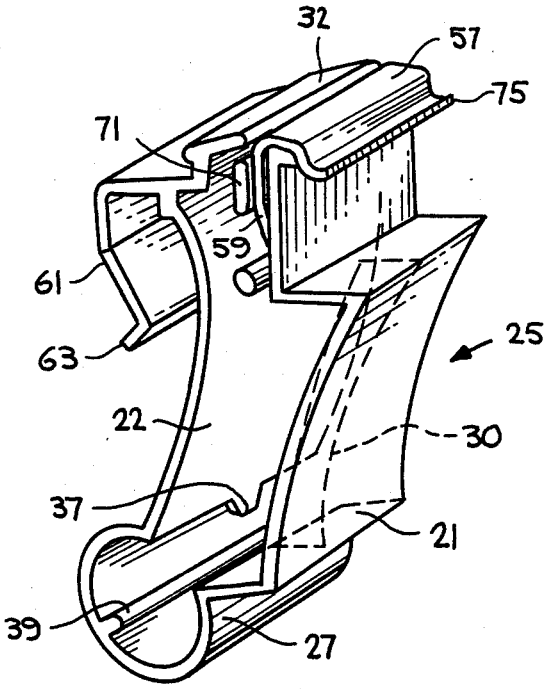
FIG. 10 is an exploded perspective front view of the tape tab-forming device of FIG. 9.

The tape tearing station may be molded as shown in FIG. 2 or may be two-piece, as shown in FIG. 10 where the second piece is a metallic hook 57, while the remainder of the body is molded from polymer material. For adaptation to a metal hook 57 as shown in FIG. 10, the shank 59 of the hook extends downwardly and is retained in a slot behind tangs 71 which are connected to strut 21 at region 73 as illustrated in FIG. 11. The forward serrated edge 75 of hook 57 is used for tearing tape.

Figure 9:
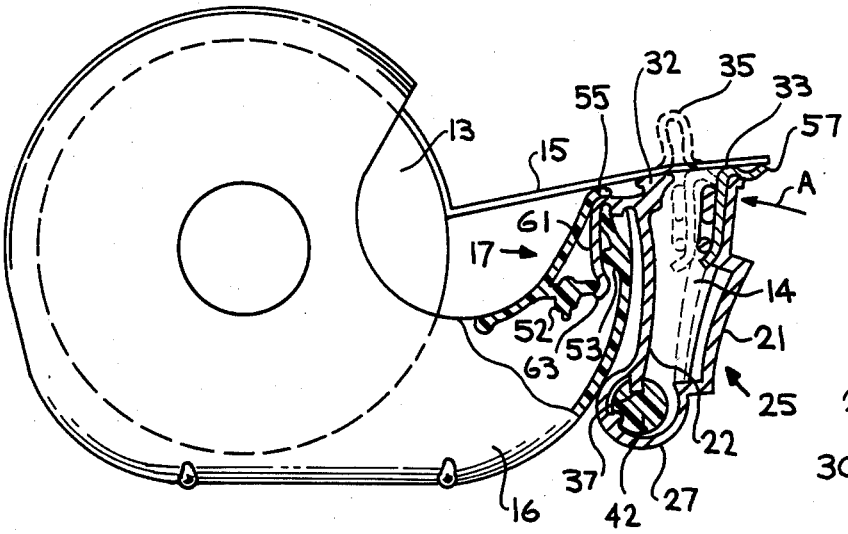
FIG. 9 is a side plan view of another embodiment of the present invention.

As shown in FIG. 9, tape tab former may also be molded as a separate unit 25 for use with existing tape roll holders such as those produced by Minnesota Mining and Manufacturing Co. This type of roll holder and station are known in the prior art and are especially popular because of low cost and convenience. While the present invention is shown for use with such a roll holder, it is not restricted to such use and may be used with other roll holders. This type of tape roll holder has anchor members 52 and 53 for the purpose of retaining a metal hook with a serrated edge for tearing tape. The hook usually passes under the apex 55 of the tape tearing station. For attachment of the tab-forming device 25 the rearward strut is modified. The upper portion of strut 22 forms the upwardly inclined wing 32 which is connected to the downwardly extending leg 61 and the curved foot 63 more clearly seen in FIG. 10. In the alternative embodiment of the present invention in which the tab-forming device is separate from an existing tape holder, metal tearing bar 57 may be removed from the existing tape holder and leg 61 and foot 63 is inserted for retention by anchor members 52 and 53 as shown in FIG. 9. The leg and foot are supported on opposite sides by anchor members 52 and 53 of the tape roll holder for attachment of the tape tab former. Operation of the tab-forming device is similar to that shown in FIG. 1. When strut 21 is pushed in the direction indicated by arrow A, the closed position of struts 21 and 22, wings 32 and 33 are in a wing-to-wing abutting relation and a tab is formed in the tape as shown by dashed lines 14 and 35. Ratchet spool 42 may be moved back and forth to seat pawl 37 in one of three pawl seats to form different tab lengths.

Rearward strut 22 is molded as a curved leg, as shown in FIG. 10, to fit the outside curvature of the upwardly extending station 17 of the existing tape roll holder.

The metal tearing bar 57 is moved to the upper extremity of the forward strut. Shank 59 is retained in a slot behind tangs 71 which are connected to the back of strut 21 as shown in FIGS. 10 and 11. The forward serrated edge 75 is used for tearing tape.

This alternative embodiment may have a molded acrylic tearing edge as previously described in reference to the molded one-piece roll holder and tab forming device of FIG. 1 and FIG. 2.

The tape tab device may thus be molded with the tape roll holder as shown in FIG. 1 or may be formed as a separate unit for attachment to existing tape holders as in FIG. 9. The tape tearing edge may be formed of metal as shown in FIG. 10 or molded on a locking device as shown in FIG. 2. By movement of the ratchet spool, the diameter of the spring may be adjusted, so that different pre-set tab lengths are possible during use of the device.

I claim:

1. A molded polymer tab forming device for attachment to a tape dispenser comprising, (a) a pair of upwardly extending forward and rearward struts, having lower and upper extremities, (b) a flexible spring comprising a cylinder having a lateral slot with front and back edges, said lower extremities of the forward and rearward struts joined respectively to said front and back edges of said slot, said struts being biased by said spring to diverge upwardly at the upper extremities, forming a spaced open position, the upper extremities of the struts each terminating in a wing, the wing of the forward strut having a forward extending tear-off section, the two wings abutting when said forward strut is pushed against said rearward strut, thereby defining a closed position, said wings forming tape tabs by movement of the struts between open and closed positions, (c) means for varying the diameter of said cylinder and altering the spacing between said upper extremities of said struts in said spaced open position to enable formation of tape tabs of variable lengths upon movement of said forward strut between said open and closed positions, and (d) anchor means on said rearward strut for rapid coupling to a tape dispenser.

2. The device of claim 1 wherein said device is molded of acetal plastic with notches removed from said upper extremity of said forward strut, said upper extremity and notches being covered by a tear-off section molded of a hard polymer.

3. The device of claim 1 wherein the upper extremity of the forward strut has at least one integral tang on a side thereof between the struts, defining a slot, and further comprising an inverted hook-shaped member having one portion detachably engaged with said tang within the slot and having a second portion extending forwardly over the upper extremity of the forward strut, having a serrated forward end to provide a tape cutting edge.

4. The device of claim 1 wherein said means for varying the diameter of said cylinder comprises a pawl on said cylinder extending parallel to and toward the center axis of said cylinder from said back edge of said slot, and a ratchet spool insertable in said cylinder, having a circular solid wall with open, circular ends and having pawl seats of increasing depth in said wall parallel to said slot for insertion of said pawl.

5. The device of claim 4 wherein said cylinder has a guide bar running lengthwise parallel to said slot and said ratchet spool has a guide slot running lengthwise in the wall of said spool matching said guide bar.

6. The device of claim 5 wherein said guide bar and said guide slot have complementary curved surfaces.

7. The device of claim 4 wherein said ratchet spool has a push button at each end of a diameter larger than the diameter of said cylinder.

8. The device of claim 4 wherein said pawl seats are angled in relation to the horizontal, said pawl seats being V-shaped with each pawl seat having a riser angle and a tread angle.

9. The device of claim 4 wherein said pawl seats form steps of increasing depth, said steps having step risers angled in relation to the horizontal.

10. The device of claim 8 wherein the pawl has tapered front and bottom edges to fit into the riser and tread angles of the pawl seat steps.

11. A molded polymer tape roll dispenser having a tap-forming device comprising, (a) a tape roll holder having a forwardly upwardly extending tape support station with upper and lower extremities, (b) a forward upwardly extending strut with upper and lower extremities, (c) a flexible spring comprising a cylinder having a lateral slot with front and back edges, said lower extremities of the station and strut joined respectively to the back and front edges of said slot, said strut being biased by said spring to diverge upwardly from the upper extremity of the station, forming a spaced-open position, the upper extremities of the station and strut each terminating in a wing, the wing of the strut having a forward extending tear-off section, the two wings abutting when said forward strut is pushed against said station thereby defining a closed position, said wings forming tape tabs by movement of the strut between open and closed position to the station, and (d) means for varying the diameter of said cylinder and altering the spacing between said upper extremities of said support station and said strut in said spaced-open position to enable formation of tape tabs of variable lengths upon movement of said strut between said open and closed positions.

12. The device of claim 11 wherein said device is molded of acetal plastic with notches removed from said upper extremity of said forward strut, said upper extremity and notches being covered by a tear-off section molded of a hard polymer.

13. The device of claim 11 wherein the upper extremity of the forward strut has at least one integral tang on a side thereof between the struts, defining a slot, and further comprising an inverted hook-shaped member having one portion detachably engaged with said tang within the slot and having a second portion extending forwardly over the upper extremity of the forward strut, said second portion having a serrated forward end to provide a tape cutting edge.

14. The device of claim 11 wherein said means for varying the diameter of said cylinder comprises a pawl on said cylinder extending parallel to and toward the center axis of said cylinder from said back edge of slot, and a ratchet spool insertable in said cylinder, having a circular solid wall with open, circular ends and having pawl seats of increasing depth in said wall parallel to said slot for insertion of said pawl.

15. The dispenser of claim 14 wherein said cylinder has a guide bar running lengthwise parallel to said slot and said ratchet spool has a guide slot running lengthwise in the wall of said spool matching said guide bar.

16. The dispenser of claim 15 wherein said dispenser is molded of acetal plastic.

17. The dispenser of claim 16 wherein notches are removed from said upper extremity of the strut, said upper extremity and notches being covered by a tear-off section molded of a hard polymer.

18. The dispenser of claim 17 wherein said hard polymer is selected from a group consisting of polystyrene and acrylic.

19. A molded polymer tape roll dispenser having a tab-forming device comprising, (a) a tape roll holder having a forwardly upwardly extending tape support station with upper and lower extremities, (b) a forward upwardly extending strut with upper and lower extremities, (c) a flexible spring comprising a cylinder having a lateral slot with front and back edges, said lower extremities of the station and strut joined respectively to the back and front edges of said slot, said strut being biased by said spring to diverge upwardly from the upper extremity of the station, forming a spaced-open position, the upper extremities of the station and strut each terminating in a wing, the wing of the strut having a forward extending tear-off section, the two wings abutting when said forward strut is pushed against said station thereby defining a closed position, said wings forming tape tabs by movement of the strut between open and closed position to the station, (d) a pawl extending parallel to and toward the center axis of said cylinder from said back edge of said slot, and (e) a ratchet spool insertable in said cylinder, having a circular solid wall with open, circular ends and having pawl seats of increasing depth in said wall parallel to said slot for insertion of said pawl whereby the diameter of said cylinder is varied and the spacing between said upper extremities of said support station and said strut in said spaced-open position is altered to enable formation of tabs of variable lengths upon movement of said strut between said open and closed positions.

* * * * *